United States Patent [19]

Blevins

[11] 4,318,519

[45] Mar. 9, 1982

[54] WASHING MACHINE HOSE GUIDE

[75] Inventor: Theodore J. Blevins, Prospect, Ky.

[73] Assignee: General Electric Company, Louisville, Ky.

[21] Appl. No.: 73,406

[22] Filed: Sep. 7, 1979

[51] Int. Cl.[3] ..... B22D 27/02

[52] U.S. Cl. ..... 248/79; 248/226.5; 248/302

[58] Field of Search ..... 248/79, 85, 86, 87, 248/88, 113, 214, 218.3, 226.5, 302, 37.3, 37.6, 227

[56] References Cited

U.S. PATENT DOCUMENTS

| | | | |
|---|---|---|---|
| 898,898 | 9/1908 | Kahn | 248/302 X |
| 1,040,645 | 10/1912 | Davis | 248/88 |
| 1,098,141 | 5/1914 | Welch | 248/75 |
| 1,211,171 | 1/1917 | Kershner | 248/37.6 |
| 1,439,031 | 12/1922 | Sterrick | 248/79 |
| 1,629,671 | 5/1927 | Alikakos | 248/227 |
| 1,746,151 | 2/1930 | Goldman | 248/75 |
| 1,803,529 | 5/1931 | Hyatt | 248/79 |
| 2,189,364 | 2/1940 | Kirsten | 248/79 |
| 2,611,568 | 9/1952 | Yoder | 248/79 |
| 2,636,704 | 4/1953 | Norberg | 248/79 |
| 2,671,626 | 3/1954 | Schmadeke | 248/75 |
| 2,853,262 | 9/1958 | Reimann | 248/75 |
| 2,894,706 | 7/1959 | Cappio | 248/87 |
| 3,220,680 | 11/1965 | Williams | 248/79 |
| 3,897,923 | 8/1975 | Paepke et al. | 248/75 |
| 4,163,457 | 8/1979 | Rickel | 248/75 X |

FOREIGN PATENT DOCUMENTS

| | | | |
|---|---|---|---|
| 5030 | of 1898 | United Kingdom | 248/37.6 |

*Primary Examiner*—William H. Schultz
*Attorney, Agent, or Firm*—Radford M. Reams

[57] ABSTRACT

A hose guide member constructed as a unitary wire-form is specifically adapted to connect an anti-kink corrugated plastic hose of an appliance such as an automatic washer to a vertical support in either a stand pipe installation or a laundry tub installation. The guide includes a single length of wire formed with a pair of open-ended hose attachment clamps at either end of a reversely bent section which is formed in the radius of the drain hose. Each attachment clamp is formed with a double turn of substantially parallel reversely bent loops with spacing matched to the pitch of the hose corrugations. The corrugations of the drain hose when placed into the clamps matingly engage the double turn loops, thereby fastening the hose to the guide in a shape conforming to the reversely bent section. Support engagement fingers extend from both attachment clamps and extend inwardly of the formed radius to cross each other. In the case of a large-sized opening such as a laundry tub installation the retaining fingers secure the guide member and hose to the support by flexing away from each other thereby frictionally engaging opposite sides of the receptacle wall. In the case of a smaller-sized opening such as a stand pipe, the retaining finger associated with the attachment clamp holding the hose end in the stand pipe is deflected against the interior wall of the stand pipe forcing the hose into engagement with the opposed interior wall thereby frictionally securing the guide and attached drain hose to the stand pipe.

3 Claims, 5 Drawing Figures

WASHING MACHINE HOSE GUIDE

BACKGROUND OF THE INVENTION

The present invention relates to devices for retaining ends of hoses and the like in desired relation to a vertical support of a drain receptacle. In the past, hosing used for draining laundry liquid from a washer to a laundry tub, stand pipe or other drain has usually been fabricated from rubber or soft flexible synthetics which can be permanently formed into desirable configurations. This type of hosing however has been susceptible to kinking, particularly if used with a movable appliance or used in an environment requiring multiple and/or tight radius bends. More recently, lightweight corrugated flexible hoses fabricated from plastic materials, such as polypropylene, have been made available for waste disposing connections. These hoses have favorable anti-kink characteristics since they are relatively stiff and are adaptable to be bent to a desirable drain configuration.

Drain hoses of domestic appliances must be capable of carrying a relatively large volume of water which, even at a relatively low pressure, tends to straighten any bends formed therein. Thus, if the drain hose is not securely fastened to a stand pipe or wash tub, the waste water may splash or spill over onto the floor. Special fittings have been developed for this purpose. Early devices for either shaping or reinforcing hoses used in a drain application are shown for example in U.S. Pat. Nos. 1,098,141; 1,439,031; 1,803,529; 2,611,568; 2,671,626 and 3,220,680, all of which employ wires to hold a hose in a desired curve and adapted to be disposed over or connected to a vertical support. U.S. Pat. Nos. 1,746,151 and 2,189,364 disclose a combination of wire forms and other sheet metal parts adapted to bend a hose and secure it to a support structure. Recently issued U.S. Pat. No. 4,163,457 discloses a termination fixture for a corrugated drain hose which utilizes either a plastic or a metal hose guide which securely attaches to and forms the hose for connection to an outlet pipe arrangement.

It is desirable then to provide a drain hose guide member which may be used with equal advantage in both a stand pipe and laundry tub installation. It is also desirable where the drain hose is of the corrugated type, to prevent over stressing of the plastic by providing a guide member which sets the bend in the hose. It is further desirable to have a guide member for a corrugated hose which protects the hose from wearing where disposed over the vertical support.

It is also desirable to provide a hose guide which can be easily fabricated from a single piece of stiff wire and which is constructed to be easily attached to a washing machine drain hose. It is further desirable to provide a washing machine hose guide which maintains the curvature or bend in the drain hose while simultaneously permitting the hose to be installed to either a drain installation having a relatively wide opening or a drain installation having a relatively narrow opening in a secure manner without modification thereto.

The present invention provides a washing machine drain hose guide member which is simple of construction, highly reliable, and which meets one or more of the requirements above described and other objectives.

SUMMARY OF THE INVENTION

A hose guide which may advantageously be used with a corrugated, plastic hose for an appliance such as an automatic washer comprises a unitary stiff wire formed in an inverted "U"-shape with downwardly depending diverging leg portions forming a downwardly opening recess to straddle the receptacle wall. Hose attachement clamps are formed transverse to said legs at the terminal ends thereof, each clamp formed with a double turn of substantially parallel reversely bent "C"-shaped loops spaced to match the pitch of the hose corrugations. The guide and hose fastened thereto is secured to the vertical wall of the specific drain receptacle installation by a pair of inverted "V"-shaped retaining fingers extending upwardly and inwardly within the "U"-shaped section in a crossed manner, the fingers constructed and arranged to flex away from each other and toward the leg portions of said guide. The fingers can either singly or jointly secure the hose and the guide to a drain opening, depending whether the opening is narrow or wide, respectively.

BRIEF DESCRIPTION OF THE DRAWINGS

In the accompanying drawings.

DETAILED DESCRIPTION OF THE PREFERRED EMBODIMENT

Figure 1:
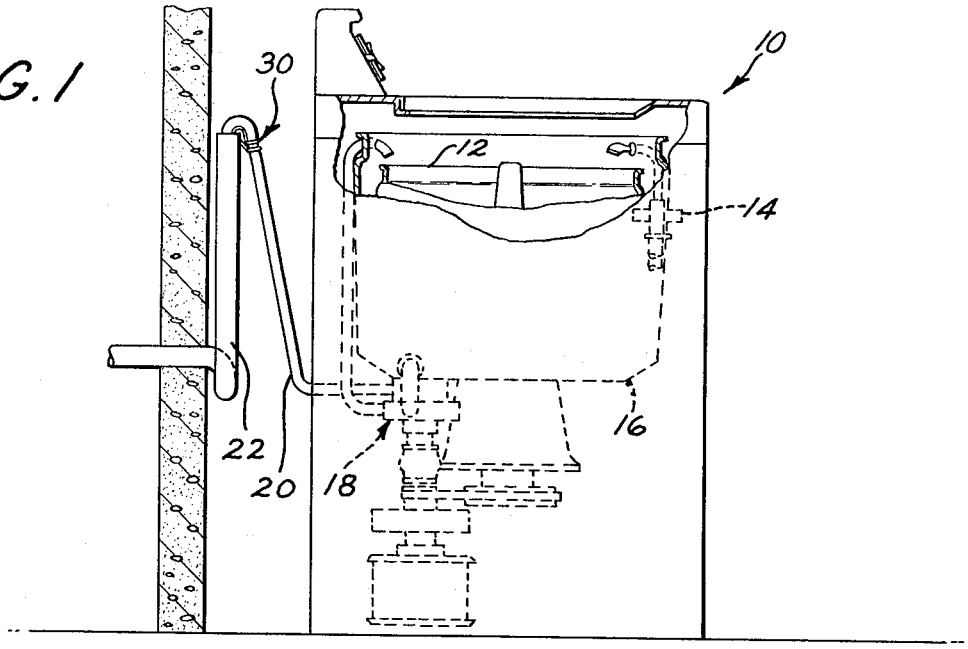
FIG. 1 is a side elevational view, partly in section, of a washing machine drain installation utilizing the drain guide of this invention.

In the following description and in the Claims, various details are identified by specific names for convenience. The names, however, are intended to be as generic in their applications as the art will permit. Like reference characters denote like parts in the several figures of the drawings.

The present invention may be utilized wherever a corrugated plastic hose may be used in connection with an appliance, such as a dishwasher or a washing machine. The exemplification used for purposes of illustration and explanation shows use particularly with an automatic washer. Referring to FIG. 1, a typical automatic washing machine installation wherein a stand pipe is used is shown, although it should be understood the invention has equal applicability and utility with a laundry tub or wash basin installation.

In FIG. 1, a washing machine 10 is supplied with hot and cold water (not shown) in a customary manner, which water is directed to the washing machine basket 12 through water valve control means 14. At the completion of the washing, rinsing and spin cycles, depending upon the particular type of machine used and cycle selected, the waste washing fluid is pumped from the tub 16 by means of a pump 18 through a drain conduit 20 into stand pipe 22. Stand pipe 22 is in turn connected to the household sewage system. The laundry liquid from the washing and rinsing operations of the machine 10 is pumped under pressure through the drain hose 20 and it is desirable therefore to fix the drain hose 20 to the drain pipe 22. As mentioned previously, the drain hose 20 could also be suitably connected to a laundry tub or other drain receptacle.

The drain hose 20 is of the anti-kink corrugated plastic type, molded for example from polypropylene and is suitably connected to pump 18. Fastened to the hose 20 at its terminal end and connected to the vertical stand pipe 22 is the hose guide 30.

In each laundry installation, it is contemplated by the present invention that the conduit or hose 20 be of the anti-kinking cylindrical type having axially spaced corrugations disposed uniformly along the length of the tubing. It should be appreciated that although this type of hose is flexible, it can be overstressed if forcefully bent through a small radius and could also be subject to chaffing if it is permitted to rub against the terminal edge of the support to which it is connected.

In accordance with the principles of the invention, hose guide 30 is selectively adaptable for use over the vertical support or side of a laundry tub, wash basiin or with a stand pipe, as shown in FIG. 1, and serves to hold the drain hose 20 fixed to the drain fixture. The structure of the hose guide 30 is shown in detail in FIGS. 2–5. Guide 30 is shown attached to the drain hose 20 in FIGS. 4 and 5, hose 20 shown partially in solid lines.

Figure 2:
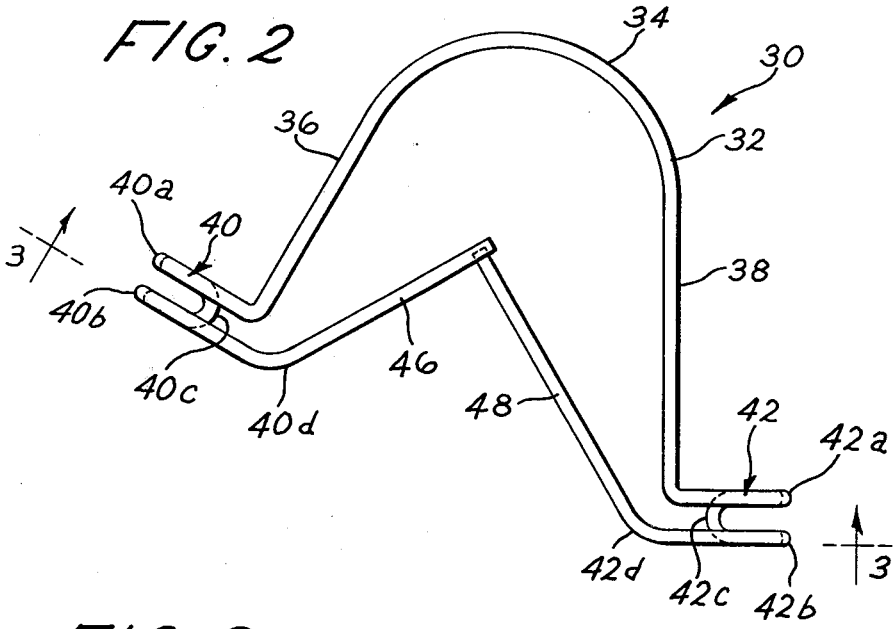
FIG. 2 is a side elevational view of a drain guide in accordance with the preferred embodiment of this invention.
Figure 3:
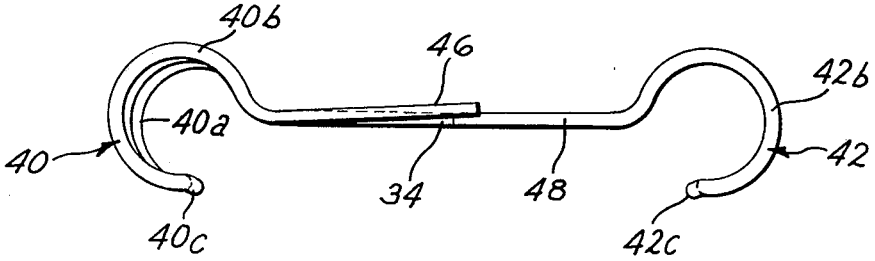
FIG. 3 is a plan view of the preferred embodiment of this invention taken along the line 3—3 of FIG. 2.

Referring to FIG. 2, hose guide 30 is shown in elevation. Guide member or clamp 30 is formed as a stiff wire member 32 formed in one piece from suitable metal material, such as spring steel. It has been found that wire of 0.100" diameter has been satisfactory in this particular application. Guide 30 is formed in the general shape of an inverted U having a reversely bent section 34 and two downardly diverging legs 36 and 38. At the terminal end of the legs 36 and 38, there is formed a pair of hose retaining loops or attachment clamps 40 and 42, respectively. Each attachment clamp 40 and 42 is formed with a double turn of substantially parallel reversely bent loops in the general shape of a C (better seen in FIG. 3) having an inwardly facing opening adapted to receive the drain hose. Each attachment member 40 and 42 has a radius corresponding generally to that of the outside of the corrugated drain hose 20. The openings in the loops 40 and 42 are suitable for transverse insertion of the hose 20, i.e. the loops open slightly to receive the hose and then close to secure the hose 20. The double turns of the loops or attachment members 40 and 42, 40*a* and 40*b*, and 42*a* and 42*b*, respectively, are spaced to matingly engage with the pitch of the hose corrugations or grooves 20*a*, shown for example in FIG. 4. The double turns 40*a* and 40*b* and 42*a* and 42*b* are interconnected by a shank portion 40*c* and 42*c*, respectively.

The radius of the reversely bent center section 34 has a radius of curvature substantially equal to the desired inside radius of a desired bend in a corrugated hose 20. The center section 34 and the legs 36 and 38 form a downardly opening recess adapted to straddle a vertical wall of the fixture to which the guide 30 is to mounted as shown in FIG. 4 and FIG. 5.

Figure 4:
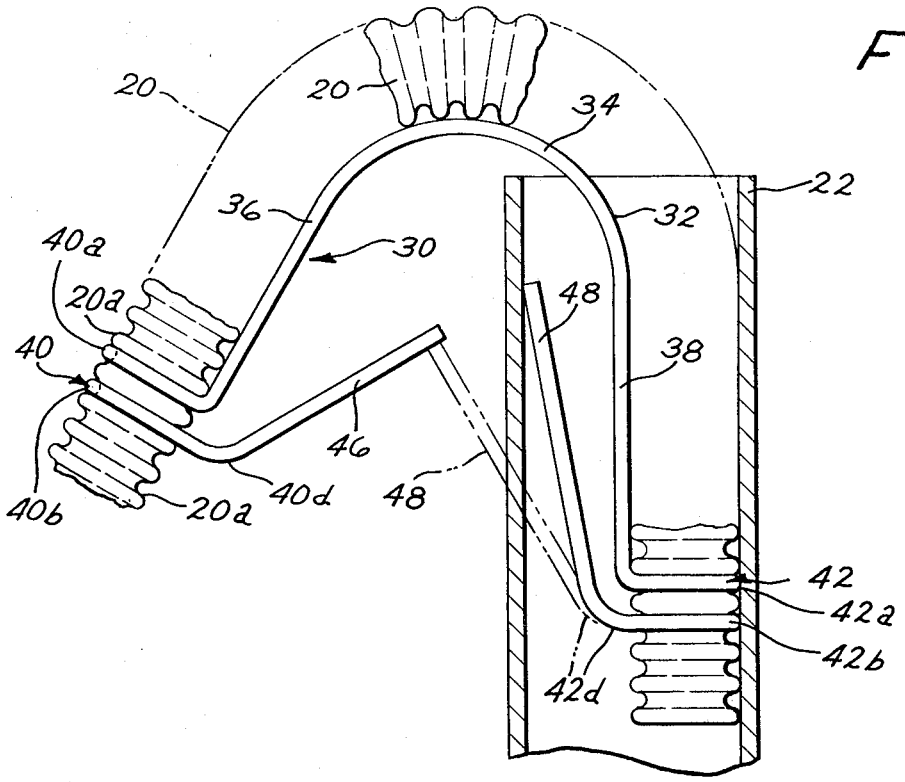
FIG. 4 is a fragmentary elevational view partially in section illustrating the hose guide of this invention utilized in a stand pipe installation.
Figure 5:
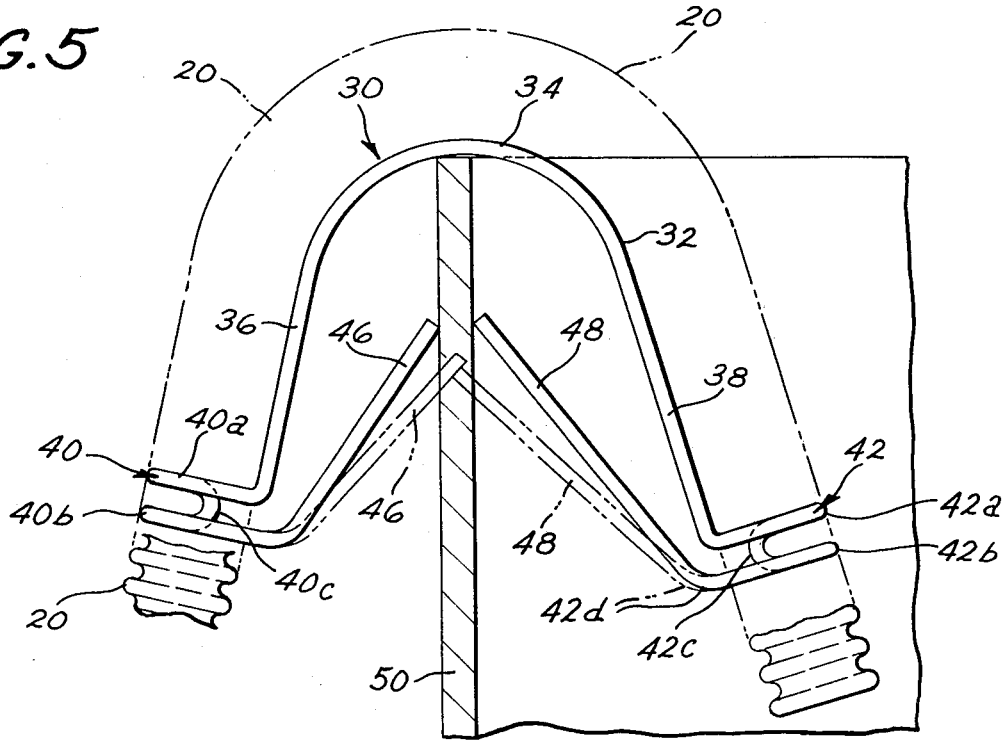
FIG. 5 is a fragmentary view partially in section of the hose guide of this invention utilized in a laundry tub installation.

Referring to FIG. 5, it will be appreciated that the center section 34 of guide 30 extends below and tangentially of the inside radius of the bend in hose 20 so that the center section 34 protects the inner portion of the hose 20 from direct chafing contact with the upper vertical edge of a tub or wash basin wall 50 (or stand pipe 22 as seen in FIG. 4).

Referring again to FIG. 2, flexible wall engagement fingers 46 and 48 are shown extending inwardly and upwardly within the U-shaped section of guide 30 so as to cross each other in the general shape of an inverted V. The fingers 46 and 48 extend from shank portions 40*d* and 42*d*, respectively, of the attachment clamps 40 and 42. Referring to FIGS. 4 and 5, one will appreciate that the spring fingers 46 and 48 are adapted to flex away from each other and toward the legs 36 and 38, respectively, the unflexed or at rest position for fingers 48 in FIG. 4 and fingers 46 and 48 in FIG. 5 being shown in phantom. In the case of a smaller-sized opening, such as stand pipe 22 shown in FIG. 4, the retaining finger 48 associated with hose clamp 42 is deflected against the interior wall of the stand pipe 22. This forces the outside radius of hose 20 into engagement with the opposed interior wall of stand pipe 22, thereby frictionally securing guide 30 and the drain hose 20 to the stand pipe 22 without altering the radius of the bend of the hose 20.

Referring to FIG. 5, which illustrates a large-size opening drain receptacle such as a vertical wall of a laundry tub or wash basin 50, both retaining fingers 46 and 48 are deflected toward the legs 36 and 38, respectively, of the guide 30, thereby frictionally engaging the interior and exterior sides of the wall 50. The fingers 46 and 48 securely hold the guide 30 and therefore the hose 20 to the drain receptacle. One will appreciate that the fingers 46 and 48 are constructed for use with walls of varying thickness since they extend sufficiently to cross each other as previously described.

One skilled in the art will also appreciate that the hose guide 30 may be formed to secure the hose 20 in any desired position compatible with a liquid receiving receptacle regardless of wall thickness or receptacle opening size with equal effectiveness and utility. One will also appreciate that a hose guide has been disclosed which can be easily fabricated from a single piece of stiff wire and which is constructed and arranged to be easily attached to a washing machine drain hose, which maintains the curvature or bend in the drain hose in a desirable radius and which further permits the hose to be installed to either a drain installation having a relatively wide opening or a relatively narrow opening in a secure manner without modification thereto. In addition, the washing machine drain hose guide of this invention is of simple construction, highly reliable, and therefore relatively inexpensive to manufacture.

Although various minor modifications may be suggested by those versed in the art, it should be understood that the scope of the patent warranted hereon shall embody all such modifications as reasonably and properly come within the scope of this contribution to the art. The embodiments of the invention in which an exclusive property or privilege is claimed are defined as follows:

What is claimed is:

1. A hose clamp for removably securing a corrugated drain hose to a generally vertical wall of a fluid receptacle; said clamp comprising a continuous piece of wire having a central hose supporting portion formed with a pair of elongated legs connected by a reversely bent section; an open-ended hose retaining loop formed at the distal end of each leg, each of said loops being generally C-shaped and comprising a pair of interconnected spaced apart turns of wire, each of said loops extending generally transverse to the axis of its adjacent leg for attaching said clamp to a drain hose with the hose extending through each of said loops and in juxtaposition to said central hose supporting portion with a hose corrugation received between said spaced apart turns of wire; and a support engagement finger projecting inwardly from each of said loops and angled toward said reversing bent section for removably mounting said clamp to a generally vertical wall.

2. A hose clamp as set forth in claim 1 wherein said fingers have an unstressed position in which their distal ends are substantially in an overlapping configuration.

3. A hose clamp as set forth in claim 1 wherein said fingers are adapted to flex outward to receive therebetween a generally vertical wall of a fluid receptacle, said fingers thereupon extending generally upwardly of the wall with the distal end of at least one of said fingers interferingly engaging the wall to inhibit movement of said clamp upwardly of the wall.

* * * * *